US006010137A

United States Patent [19]

Keleny

[11] Patent Number: 6,010,137

[45] Date of Patent: Jan. 4, 2000

[54] QUICK ADJUSTING BRAKING APPARATUS

[75] Inventor: Lloyd G. Keleny, Champlin, Minn.

[73] Assignee: Rollerblade, Inc., Eden Prairie, Minn.

[21] Appl. No.: 09/087,713

[22] Filed: Jun. 1, 1998

[51] Int. Cl.[7] ..... A63C 17/14

[52] U.S. Cl. ..... 280/11.2; 188/5

[58] Field of Search ..... 280/11.2, 11.19, 280/11.22, 11.23; 74/567, 100.1, 107, 99 A; 188/5

[56] References Cited

U.S. PATENT DOCUMENTS

| | | | |
|---|---|---|---|
| 5,335,924 | 8/1994 | Richards, Sr. et al. | 280/11.2 |
| 5,462,296 | 10/1995 | Pozzobon . | |
| 5,465,984 | 11/1995 | Pellegrini, Jr. et al. | 280/11.2 |
| 5,486,012 | 1/1996 | Olivieri | 280/11.2 |
| 5,505,469 | 4/1996 | Zorzi et al. . | |
| 5,511,804 | 4/1996 | Pellegrini, Jr. et al. | 280/11.2 |
| 5,570,759 | 11/1996 | Zorzi | 280/11.2 |
| 5,590,889 | 1/1997 | Pozzobon . | |
| 5,634,647 | 6/1997 | Gorza et al. | 280/11.2 |
| 5,649,715 | 7/1997 | Mitchell | 280/11.2 |
| 5,653,454 | 8/1997 | Chin | 280/11.2 |
| 5,655,783 | 8/1997 | Brosnan | 280/11.2 |
| 5,702,113 | 12/1997 | Gonella et al. | 280/11.2 |
| 5,735,537 | 4/1998 | Zorzi | 280/11.2 |
| 5,741,017 | 4/1998 | Chen | 280/11.2 |

FOREIGN PATENT DOCUMENTS

| | | |
|---|---|---|
| 0 694 321 | 1/1996 | European Pat. Off. . |
| 0 608 740 | 7/1997 | European Pat. Off. . |
| WO 97/09099 | 3/1997 | WIPO . |
| WO 97/09100 | 3/1997 | WIPO . |
| WO 97/11758 | 4/1997 | WIPO . |
| WO 97/11759 | 4/1997 | WIPO . |

*Primary Examiner*—Lanna Mai
*Assistant Examiner*—Andrew J. Fischer
*Attorney, Agent, or Firm*—Merchant & Gould P.C.

[57] ABSTRACT

A braking apparatus is provided for a skate which comprises a shoe composed of at least one quarter connected to a shell associated with a supporting frame for a plurality of wheels. The braking apparatus includes a braking element connected to a rear portion of the supporting frame adjacent the wheels. A brake arm is connected between the quarter of the skate and the braking element. The brake arm includes a first member and a second member connected together with the first member moveable with respect to the second member. The brake arm includes a switch mechanism operable between a first and second position. Upon activation of the switch mechanism from the first position to the second position, the first member of the brake arm moves away from the second member of the brake arm such that the length of the brake arm is increased and the braking element is positioned lower with respect to the wheels of the skate. Upon activation of the switch mechanism from the second position to the first position, the first member moves toward the second member of the brake arm to decrease the length of the brake arm such that the braking element is positioned higher with respect to the wheels of the skate.

6 Claims, 4 Drawing Sheets

QUICK ADJUSTING BRAKING APPARATUS

BACKGROUND OF THE INVENTION

1. Field of the Invention

This invention relates generally to a braking apparatus for use with an in-line skate and, more particularly, to a two-position adjustable brake arm.

2. Description of the Invention

In the field of in-line skates, it is known to provide a skate comprising a shoe composed of an upper quarter connected to a lower shell portion which is associated with a supporting frame having a plurality of wheels mounted therein. It is further known to provide a braking device for use with an in-line skate wherein the braking element is pivotally connected to the back end of the frame so that the braking element is positioned adjacent the rear wheel of the in-line skate (See FIG. 1). The braking device includes a braking arm which connects the braking element, secured to the lower frame of the skate, to the upper quarter of the skate. In this way, the braking device is activated when the skater pivots the upper quarter rearward to thus force the brake arm downward, which then pivots the braking element connected to the frame into contact with the ground to provide a frictional force to retard the motion of the skate. When the skater wishes to continue, the skater pivots the upper quarter back to the normal position and the brake arm moves upward to pivot the braking element out of contact with the ground and back to the normal skating position. Accordingly, in the normal skating position, the braking element which includes the brake pad is disposed slightly above the bottom of the skating wheels (ground level).

It is further known to provide an ABT brake adjustment with the braking device. Typically, an ABT brake adjustment consists of a rotatable adjustment member having an inner bore which receives a fixed bolt or screw so that rotation of the adjustment member moves the adjustment member and accordingly the braking element and brake pad up or down, depending on the direction of rotation. The use of the ABT brake adjustment permits a skater to set the braking element at a desired level above the ground. The ABT brake adjustment does not lend itself toward quick and easy lowering and raising of the brake. Typically, the ABT brake adjustment is useful to finely adjust the position of the brake as the brake pad wears down over the course of normal use. In this way, the ABT adjustment member adjusts the braking device downward to maintain a similar vertical displacement of the brake with respect to the ground.

One problem with the ABT brake adjustment is that it does not allow quick and easy lowering and raising of the brake with respect to the skate. For example, by positioning the brake lower to the ground, the skater is provided with more braking control and faster braking response in stopping the skate. If the skater is about to proceed down a hill, the skater may want to adjust the brake downward to provide additional braking control as the skater proceeds down the hill. The ABT brake adjustment does not allow for quick adjustment of the brake to a significantly lower position for such a situation and similarly does not provide fast and easy retraction of the brake back to the upper position after the skater has resumed normal skating. Rather, a skater would be forced to rotate the ABT member a significant amount to obtain noticeable movement of the brake in either direction.

U.S. Pat. No. 5,462,296 discloses a braking device which allows for deactivation of the braking element. The braking device includes two arms coupled to a threaded sleeve so that rotation of the threaded sleeve varies the position of the braking element with respect to the ground. Such a device, however, does not provide for quick adjustment of the braking element between an upper and lower position.

What is needed is a two-position quick adjustment braking apparatus which allows for quick and easy lowering and raising of the brake element with respect to the ground. What is further needed is a quick adjustment braking device which is easy for the user to switch from the normal upper position to the lower extended position and subsequently from the lower extended position back to the normal upper position.

SUMMARY OF THE INVENTION

The present invention provides a braking device for an in-line skate which provides a two-position quick adjustment brake apparatus for lowering and raising of the brake element with respect to the ground. Further, the braking apparatus provides for easy switching back and forth between the two positions.

According to one aspect of the present invention, there is provided a braking apparatus for an in-line skate where the skate includes a shoe composed of at least one quarter connected to a shell associated with a supporting frame for housing a plurality of wheels. The braking apparatus includes a braking element connected to a rear portion of the supporting frame adjacent to the wheels. The braking apparatus further includes a brake arm connected between the quarter of the skate and the braking element. The break arm includes a first member and a second member connected together with the first member moveable with respect to the second member. The brake arm includes a switch mechanism operable between a first and second position. Upon activation of the switch mechanism, the first member moves away from the second member from a first position to a second position wherein the length of the brake arm is increased such that the braking element is positioned lower with respect to the wheels of the skate.

According to one embodiment of the invention, the brake arm comprises a first member and second member disposed with an end of the first member adjacent an end of the second member with the first member rotatably disposed therein. The adjacent ends of the first and second member are formed as angled faces with the faces substantially parallel and in contact in a first position with the brake arm in an upper position. Upon rotation of the first member with respect to the second member, the angled face of the first member acts as a cam to force the first member away from the second member to a second position wherein the length of the brake arm is increased to position the braking element lower with respect to the wheels of the skate. The second member preferably includes a notched cut-out portion in the angled face wherein upon rotation of the first member from the first to the second position, the angled cam face of the first member engages the notched portion of the second member to maintain the first member in the second position wherein the length of the brake arm is increased.

Pursuant to another embodiment of the present invention, the brake arm includes a first member and a second member, the first member having an engagement member including a tab and the second member including a cavity for receiving the engagement member therein and including an upper and lower detent adapted for engagement with the tab of the engagement member. The engagement member includes a push button switch connected thereto such that the exertion of force on the push button switch disengages the tab from engagement with the upper or lower detent and the push button switch is slidable to allow the tab of the engagement member to move between the upper and lower detent such that the length of the brake arm is increased or decreased. The second member preferably includes a slot such that the push button switch is slidable within the slot between the first and second position where the tab engages the upper or lower detent.

According to another embodiment of the present invention, the brake arm includes a first member and second member, the first member having a base portion and an extension portion and the second member having an end adjacent the first portion including a slot adapted to receive the extension portion therein such that the extension portion is slidable within the slot of the second member. The braking device includes a switch mechanism comprising an over center linkage having a first pivot arm having one end pivotally connected to the extension portion of the first member with the other end of the pivot member forming a handle or lift lever. The switch includes a second pivot arm having one end pivotally connected to the second member with the opposite end connected to the first pivot arm between the two ends. The brake arm is disposable in a first position with the extension portion of the first member disposed within the slot of the second member. The brake arm is pivotable to a second position wherein the extension portion of the first member slides partially out of the slot to a second position such that the length of the brake arm is increased. This is accomplished through lifting the handle portion of the first pivot arm which forces the extension portion to slide out of the slot of the second member with the first pivot arm flipping its orientation to an over center position to maintain the first member of the brake arm in an extended second position to increase the length of the brake arm.

Pursuant to another embodiment of the present invention, the brake arm includes a first member disposed within a second member and is rotatable therein. The first member includes a cross pin and the second member includes a spiral cam groove or slot for receiving the cross pin therein. The cross pin of the first member is movable from the upper end of the spiral cam slot to the lower end of the spiral cam slot. With the cross pin retained in the upper end of the spiral cam slot, the rotation of the first member forces the cross pin along the spiral cam slot to the lower end of the slot wherein the first member extends away from the second member such that the length of the brake arm is increased.

Pursuant to another embodiment of the invention, the brake arm has a first member having one end terminating in a ring-shaped portion adapted to receive a cylindrical cam member disposed therein. The cam member is rotatable within the ring-shaped end of the first member. A pivot rod extends through the cam member and is securely connected to the upper quarter portion of the in-line skate. The pivot rod is disposed at an eccentric position with respect to the center of the cam member. Upon exertion of force upon the pivot rod, the cam member is rotatable within the ring-shaped end of the first member such that the cam member forces the first member between an upper and lower position such that the length of the brake arm is increased or decreased upon rotation of the cam member. Preferably, the pivot rod includes a handle-shaped lift lever to facilitate rotation of the cam member for adjustment of the brake arm between the first and second position.

The above-described features and advantages, along with various other advantages and features of novelty, are pointed out with particularity in the claims of the present application which form a part hereof. However, for a better understanding of the invention, its advantages, and objects obtained by its use, reference should be made to the drawings which form a further part of the present application and to the accompanying descriptive matter in which there is illustrated and described preferred embodiments of the invention.

DETAILED DESCRIPTION OF THE INVENTION

Figure 1:
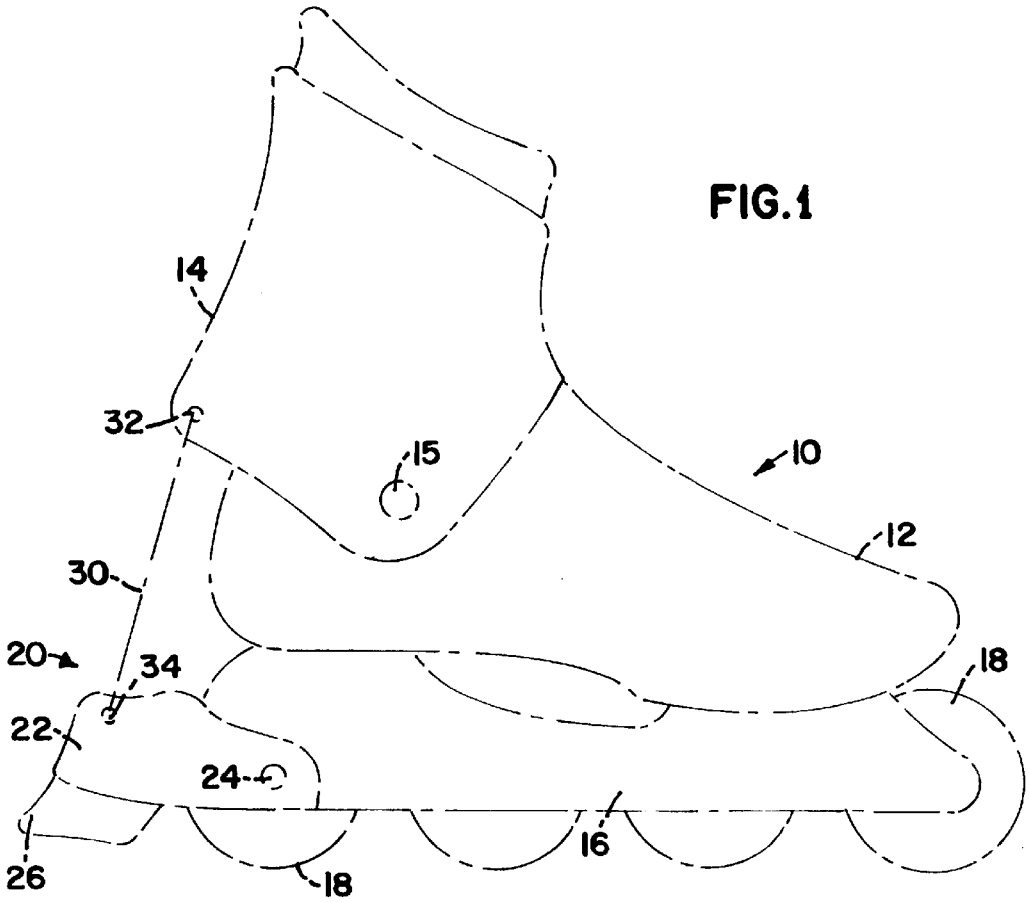
FIG. 1 is a side view of an in-line skate having a braking element secured to the rear of the frame illustrating the location of the braking arm between the braking element and the upper quarter of the skate.

Referring now to the drawings in which similar elements are numbered identically throughout, a description of preferred embodiments is provided. In FIG. 1, a side view of an in-line skate is generally illustrated at 10. A typical in-line skate will include a shell 12 and an upper quarter 14 which is pivotally connected to the shell at 15. A frame 16 is connected to the shell 12 with the wheels 18 disposed within the frame 16.

Referring to FIG. 1, the in-line skate includes a brake apparatus 20 having a brake element 22 which is pivotally connected to the frame 16 at 24. The brake element 22 includes a brake pad 26 which is disposed slightly above the bottom of the rear wheel of the skate. A brake arm 30 is designed to connect the brake element 22 with the upper quarter 14 of the skate with the brake arm secured between an upper connecting rod 32 and a lower connecting rod 34. In this way, as the upper quarter 14 of the skate 10 is pivoted toward the rear of the skate, the brake arm 30 is forced downward to pivot the brake element 22 corresponding downward so that the brake pad 26 engages the ground to provide a braking force for the skate.

Typically, the brake arm 30 includes an ABT brake adjustment which is shown in the embodiment in FIGS. 2–10. The ABT adjustment includes an adjustment member 36 having an internal bore for engagement with the corresponding shaft 38. The adjustment member 36 is connected to the brake element 22 since that rotation of the adjustment member 36 about shaft 38 moves the adjustment member correspondingly upward or downward to adjust the position of the brake element 22 with respect to the frame 16 and wheels 18 of the skate 10. Typically, the ABT adjustment is used to adjust the height of the brake pad 26 as the brake pad wears down during use. The ABT adjustment number is not just for rapid adjustment of the height of the brake element during use by the skater. It is further noted that while the embodiments shown herein display an ABT adjustment member, the invention may be used in a brake apparatus that does not have an ABT adjustment member.

In general, the braking apparatus of the present invention provides for rapid adjustment of the length of the brake arm between a first upper position and a second lower position to reposition the brake pad with respect to the ground. This is accomplished through a brake arm having a first member and a second member with the first member movable with respect to the second member to adjust the length of the brake arm. A switch mechanism is utilized for movement of the brake arm between the first upper position and second lower position. The switch mechanism may take a variety of forms. In the embodiments set out below, the switch mechanism may constitute the particular structure of the first and second members of the brake arm which allows for quick adjustment in the length of the brake arm between an upper and lower position. Alternately, the switch mechanism may constitute a specific structure or linkage attached to the first and second members of the brake arm for rapid adjustment in the length of the brake arm between an upper and lower position.

Figure 2:
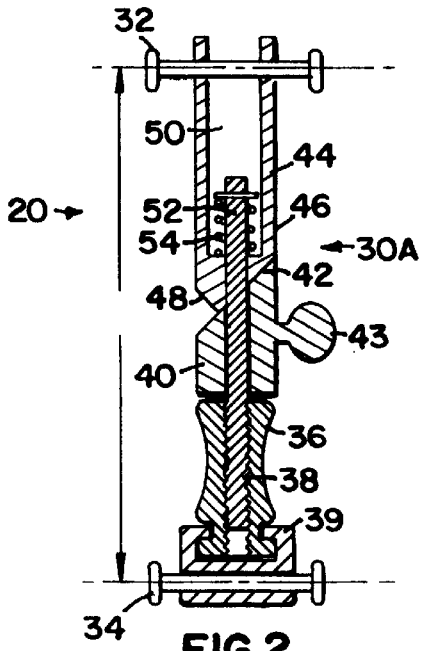
FIG. 2 is a cross-sectional front view of one embodiment of a braking apparatus according to the principles of the present invention with the brake arm shown in the first upper position.
Figure 3:
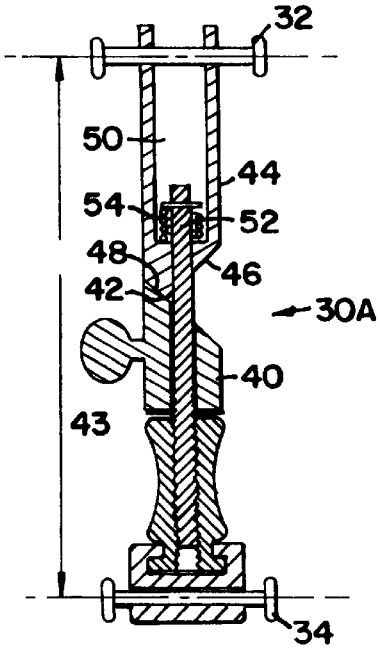
FIG. 3 is a cross-sectional front view of the braking apparatus shown in FIG. 2 with the device shown in the second extended position wherein the length of the brake arm is increased.

Referring now to FIGS. 2–3, a first embodiment of a braking apparatus according to the principles of the present invention is generally illustrated at 20. The brake apparatus 20 includes a brake arm 30A having a first member 40 and a second member 44 which are aligned longitudinally. The first member includes an angled cam face 42 adjacent a corresponding angled face 46 of the second member. The two ends faces 42, 46 of the first and second members 40, 44 are substantially parallel and in contact when the brake arm 30A is in the first position as shown in FIG. 2. FIG. 2 further shows the second member 44 of the brake arm secured to upper connecting rod 32 which is attached to the upper quarter 14 of the skate 10. The ABT adjustment member 36 is shown secured to a shaft 38 with the bottom of the ABT adjustment member 36 rotatably connected to a spacer member 39 which in turn is connected to the lower connecting rod 34. The braking element 22 (not shown) would then be secured to the connecting rod 34 as well to the frame 16 to form a linkage between the upper quarter 14 of the skate 10 through the brake arm 30A to the braking element 22.

The brake arm 30A is moveable between a first normal or raised position as shown in FIG. 2 in which the brake element 22 is positioned at a position above the ground for use during normal skating. The brake arm 30A is moveable to a second extended position as shown in FIG. 3 where the length of the brake arm 30A is increased such that the brake element 22 is disposed lower to the ground. This allows the skater increased control due to the proximity of the brake with respect to the ground. The brake arm 30A provides for quick adjustment between the first and second positions through the rotation of the first member 40. In particular, first member 40 is rotated such that the angle cam face 42 forces itself away from the angled face 46 of the second member 44 thus increasing the length of the brake arm 30 (see FIGS. 2–3).

In a preferred embodiment, the first member 40 is rotated 180° to provide maximum vertical displacement of the brake arm 30A. The second member 44 preferably includes a notch 48 formed as a cut-out portion in the angled face 46 at the lower end of the angled face. The notch is cut at an angle such that when the first member is rotated to the second position, the angle of the notch 48 is substantially parallel the angled cam face 42. In this way, rotation of the first member 180° to the second position results in the angled cam face 42 engaging the notch 48 of the second member to maintain the first member in the second position. Preferably, the notch is formed at approximately the same angle as the angled face 46 (in the opposite direction). In a preferred embodiment, the angle of the angle cam face 42 is approximately 25 degrees.

Accordingly, in use, the skater simply rotates a handle 43 of the first member 40 180° so that the angled cam face 42 is disposed in the notch 48 of the second member 44 to quickly and conveniently lengthen brake arm 30A. For example, if a skater is about to proceed down a hill, the skater may simply rotate the handle 43 of the first member 40 to lengthen the brake arm and provide more braking control and the skater may then proceed down the hill. When the skater desires to resume normal skating, the skater simply rotates the first member 40 out of the notch 48 of the second member 44 back to the first position where the angle face 46 of the second member 44 is parallel and in engagement with the angled cam face 42 of the first member 41 and the length of the brake arm 30A is returned to the normal upper position.

It is appreciated that while one particular embodiment discloses rotation of the first member 180° with respect to the second member, the amount of rotation may be varied to provide for varying vertical displacement of the brake arm between the first upper position and second lower position. Similarly, the angle of the adjacent end faces of the first and second members may be varied as well to provide for different vertical displacement.

Referring to FIG. 2, the brake arm 30A preferably includes a biasing mechanism for maintaining the first member 40 in contact with the second member 44. In one embodiment, a connector member 52 is disposed between the first member 40 and the second member 44. The second member 44 includes a cavity portion 50 for receiving a portion of the connector member 52 therein. A spring 54 disposed between the end of the connector member 52 and the base of the cavity 50 of the second member 44. In this way, the connector member 52 and spring 54 bias the second member 44 into engagement with the first member 40 so that as the first member is rotated between the first and second positions, the angled cam face 42 of the first member continuously engages the angled face 46 or notch 48 of the second member 44.

Figure 4:
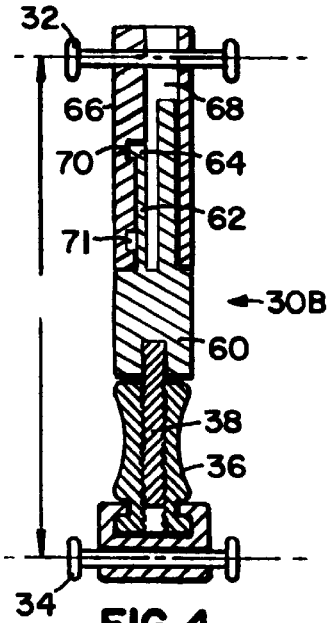
FIG. 4 is a cross-sectional front view of a second embodiment of a braking apparatus according to the principles of the present invention with the brake arm shown in the first upper position.
Figure 5:
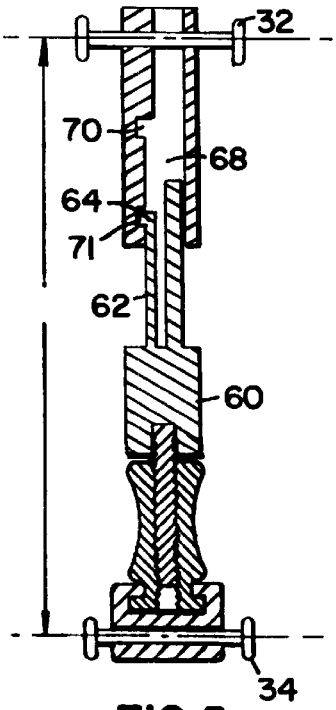
FIG. 5 is a cross-sectional front view of the braking apparatus shown in FIG. 4 with the brake arm shown in the second extended position.

According to FIGS. 4–5, another embodiment of the present invention is illustrated. In this embodiment, the brake arm 30B includes a push button mechanism for movement of the brake arm between a first upper or normal position (FIG. 4) and a second extended position (FIG. 5). In this embodiment, the brake arm 30B includes a first member 60 having an engagement portion 62 which includes a tab 64. The brake arm 30 further includes a second member 66 having a cavity 68 for receiving the engagement portion 62 of the first member 60 therein. The cavity 68 of the second member 66 includes an upper detent 70 and a lower detent 71 adapted for engagement with the tab 64 of the first member 60. A push-button switch (not shown) is connected to the engagement portion 62 of the first member so that the user may apply force on the engagement portion 62 to disengage the tab 64 from connection with the upper detent 70 or lower detent 71 and slide the first member 60 between the first and second positions.

In operation, the first member 60 is disposed in a first position (see FIG. 4) in which the tab 64 of the engagement portion 62 is disposed within the upper detent 70 of the second member 66 so that the braking element is disposed at the normal upper position above the ground. To shift the brake arm 30B to the second extended position, the user depresses the push-button switch to disengage the tab 64 from the upper detent 70 so that the engagement portion 62 of the first member 60 is then slideable to the second position where the tab 64 engages the lower detent 71 of the second member. With brake arm 30B in the second position, the brake element 22 is lowered with respect to the ground for added braking control. To switch the brake arm 30B back to the first position, the user simply pushes on the push-button switch to disengage the tab 64 of the first member from the lower detent 71 of the second member 66 and then slides the first member 60 upward within the second member 66 until the tab 64 engages the upper detent 70. Preferably, the second member 66 would include a corresponding slot so that the push-button switch is readily able to slide between the first and second positions.

Figure 6:
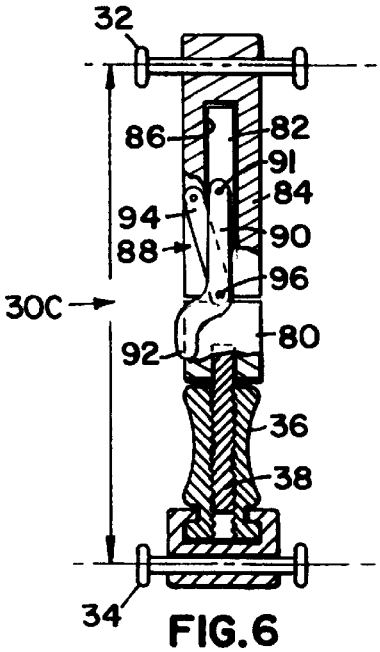
FIG. 6 is a partial cross-sectional view of a third embodiment of a braking apparatus according to the principles of the present invention with the brake arm shown in the first upper position.
Figure 7:
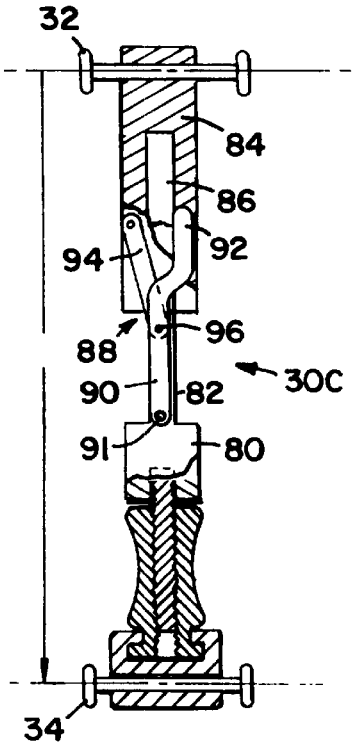
FIG. 7 is a partial cross-sectional view of the braking apparatus shown in FIG. 6 with the brake arm shown in the second extended position.

Referring to FIGS. 6–7, another embodiment of a braking apparatus according to the principles of the present invention is illustrated. In this embodiment, the brake arm 30C includes a first member 80 having an extension portion 82 and a second member 84 includes a slot 86 for receiving the extension portion 82 therein. An over-center linkage mechanism 88 is provided to switch the brake arm 30C between the first upper or normal position (FIG. 6) and a second lower or extended position (FIG. 7). The over-center linkage mechanism 88 includes a first pivot arm 90 which is pivotally connected at one end 91 to the extension portion 82 of the first member 80. First pivot arm 90 further includes a handle portion 92 opposite the end 91 attached to the first member 80. A second pivot arm 94 has one end pivotally connected to the second member 84 with the opposite end of the second pivot arm connected to the first pivot arm at a central pivot point 96. This central pivot point 96 is between the handle 92 and the end 91 of the first pivot arm 90 connected to the first member 80.

In operation, brake arm 30C is disposed in a first position with the extension portion 82 of the first member 80 fully disposed within the slot 86 of the second member 84 with the over-center linkage mechanism 88 positioned with the end of the pivot arms adjacent to each other. To move the brake arm 30C to the second extended position, a user pulls up on the handle 92 of the over-center linkage 88 such that the over-center linkage 88 forces the extension portion 82 to slide downward partially out of the slot 86 of the second member 84. In this way, the first member 80 is extended to increase the length of the brake arm and position the brake element at a lower position with respect to the ground. As the over-center linkage 88 is pivoted to the second position, the first pivot arm 90 flips its orientation and moves over center so that the central pivot point 96 is now positioned longitudinally above the pivot point connection 91 of the first pivot arm and the extension member (See FIG. 7). To switch the brake arm back to the first upper position, the user simply flips the handle 92 of the over-center linkage 88 downward so that it flips its orientation over-center back to the first position where it forces the extension portion 82 back into the slot 86 of the second member 84 to return the brake element to its normal raised position.

Figure 8:
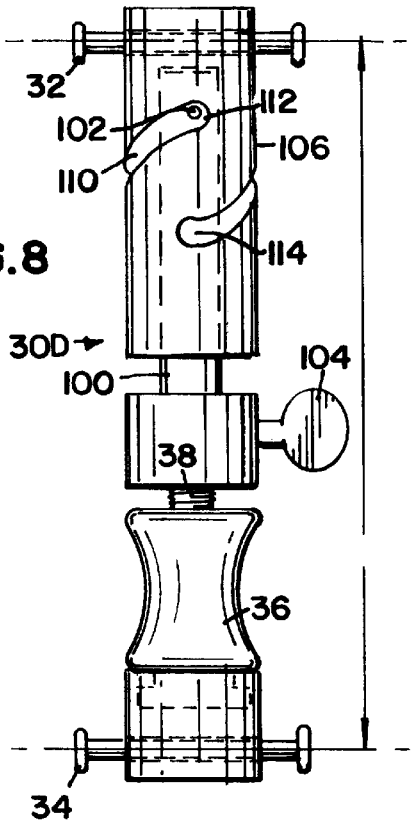
FIG. 8 is a front plan view of a fourth embodiment of a braking apparatus according to the principles of the present invention with the brake arm shown in the first upper position.
Figure 9:
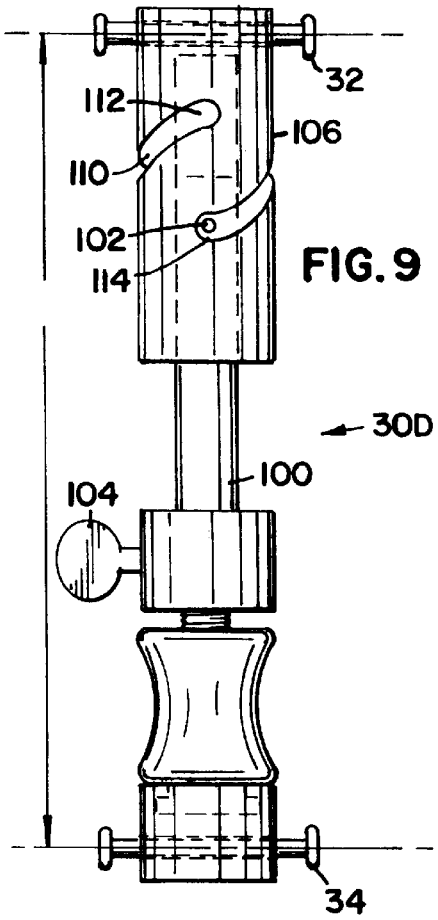
FIG. 9 is a front plan view of the braking apparatus shown in FIG. 8 with the brake arm shown in the second position.

Referring to FIGS. 8–9, a further embodiment of the brake apparatus according to the principles of the present invention is illustrated. In this embodiment, the brake arm 30D includes a first member 100 which is rotatably disposed within a second member 106 having an internal bore 108 for receiving the first member 100 therein. First member 100 includes a cross-pin 102 with the second member 106 having a spiral cam slot 110 for receiving the cross-pin 102 of the first member 100 therein.

The first member 100 is moveable between a first upper position (FIG. 8) and a second extended position (FIG. 9) to provide easy adjustment of the length of the brake arm 30D. In the first position, the cross-pin 102 is retained at the upper end 112 of the spiral cam slot 110 of the second member 106. To move to the second position, the first member 100 is rotated such that the spiral cam slot 110 forces the cross-pin 102 along the slot 110 until the cross pin is retained at the lower end 114 of the spiral cam slot 110. This movement of the cross pin 102 along the cam slot 110 forces the first member 100 away from the second member 106 to increase the length of the brake arm 30D. The first member 100 preferably includes a handle switch 104 to facilitate rotation of the first member 100 to switch the brake arm 30D between the first and second positions.

In operation, the skater simply rotates the handle switch 104 of the first member 100 so that the cross-pin is forced along the spiral cam slot 110 between the upper end 112 and lower end 114 of the slot to thus quickly and conveniently adjust the brake arm 30D between the upper and lower positions. It is appreciated that by varying the length and slope of the spiral cam slot 110, the vertical displacement of the brake arm between the first upper position and second lower position is accordingly varied.

Figure 10:
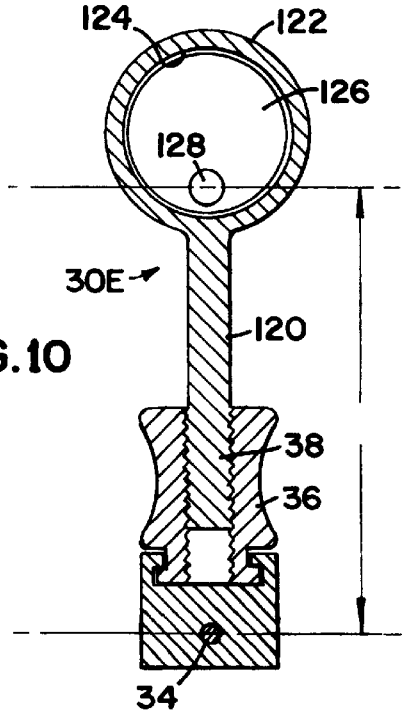
FIG. 10 is a cross-sectional side view of a fifth embodiment of a braking apparatus according to the principles of the present invention with the brake arm shown in the first upper position.
Figure 11:
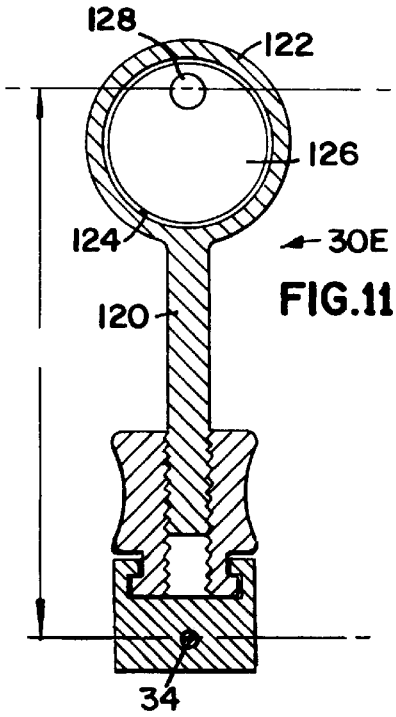
FIG. 11 is a cross-sectional side view of the braking apparatus shown in FIG. 10 with the brake arm shown in the second extended position.
Figure 12:
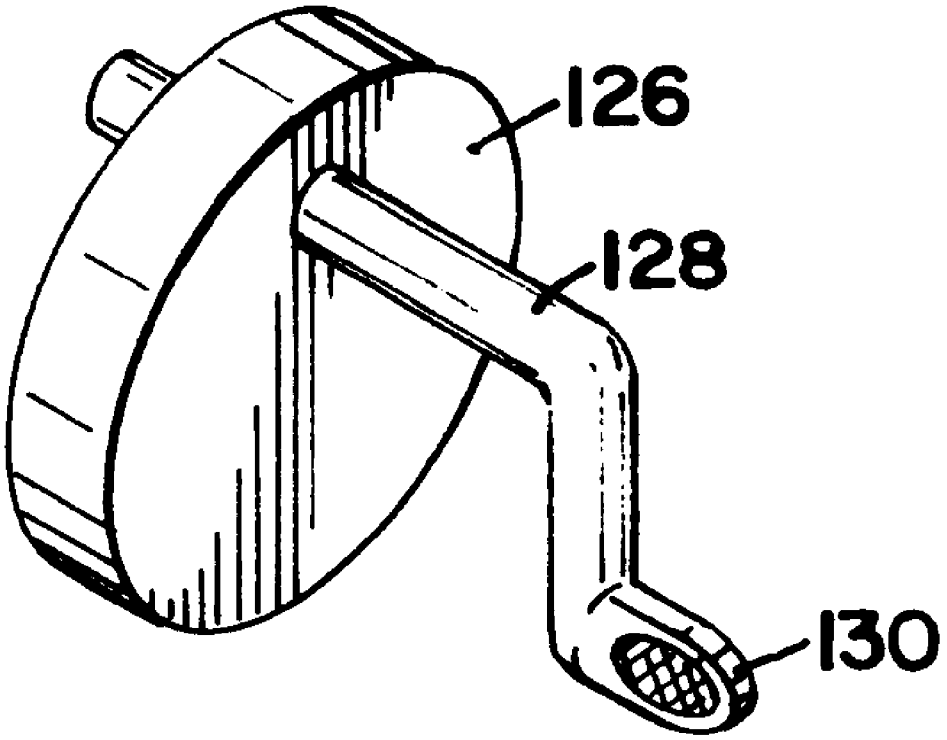
FIG. 12 is a perspective view of the cam member of the braking apparatus shown in FIG. 10.

Referring to FIGS. 10–12, another embodiment of the braking apparatus according to the principles of the present invention is illustrated. In this embodiment, the brake arm 30E includes a first member 120 having one end terminating in a circular or ring portion 122 having an opening 124. A second member or rod end cam 126 having a cylindrical shape is disposed within the opening 124 of the ring end 122 of the first member 120 and is rotatable therein. The rod end cam 126 includes a pivot connecting rod 128 which is disposed at an eccentric position offset from the center of the rod end cam 126 (See FIG. 12). The pivot connecting rod 128 serves as the upper connecting rod to connect brake arm 30E to the upper quarter 14 of the skate 10. The pivot connecting rod 128 preferably includes a handle or lift lever portion 130 extending therefrom. The first member 120 is moveable between a first upper or normal position (FIG. 10) and a second lower or extended position (FIG. 11) in which the length of the brake arm is increased to thus position the braking element lower with respect to the ground. The brake arm 30E is switched from the first to the second position by rotation of the pivot connecting rod 128 which serves to rotate the rod end cam 126 within the ring end 122 of the first member 120 as the pivot connecting rod 128 is rotatably fixed in position in connection to the upper quarter 14 of the skate. Rotation of the rod end cam 126 forces the first member 120 to the second lower position (FIG. 11) while the continued rotation of the pivot connecting rod 128 and rod end cam 126 serves to force the first member 120 back to the first position (FIG. 10).

In operation, the skater grips the handle or lift lever 130 of the pivot connecting rod 128 to apply force thereto such that the rod end cam 126 rotates within the ring end 122 of the first member 120 to force the first member 120 to the second position, and thus lengthens the brake arm 30E providing increased braking control for the skater. The skater simply flips the handle or lift lever 130 from its extended position of FIG. 11 to rotate the rod end cam 126 and bring the first member back to the upper position for normal skating (FIG. 10).

It is appreciated that the use of the braking apparatus according to the principles of the present invention provides for quick adjustment of the length of the brake between a first upper and a second lower position. This allows a skater to make an easy and convenient adjustment of the braking device according to the skating conditions. If the skater is a beginner or is in a situation requiring added braking control, he or she simply switches the braking apparatus from the first to the second position to lengthen the brake arm to provide increased braking control and a faster braking response. If the skater desires normal braking control, the skater simply switches the braking apparatus back to the first position from the second position to decrease the length of the brake arm and return the braking element back to the upper or normal position.

It is to be understood that even though numerous characteristics and advantages of various embodiments of the present invention have been set forth in the foregoing description, together with the details of the structure and function of various embodiments of the invention, this disclosure is illustrative only and changes may be made in a detailed, especially in matters of shape, size and arrangement of principles of the present invention, to the full extend indicated by the broad general meaning of the terms in which the appended claims are expressed.

Other modifications of the invention will be apparent to those skilled in the art in view of the foregoing descriptions. These descriptions are intended to provide specific examples of embodiments which clearly disclose the present invention. Accordingly, the invention is not limited to the described embodiment or to use of specific elements, dimensions, materials or configurations contained therein. All alternative modifications and variations of the present invention which fall within the spirit and broad scope of the appended claims are covered.

What is claimed is:

1. A braking apparatus for use in a skate having a shoe composed of at least one quarter connected to a shell associated with a supporting frame for a plurality of wheels, the braking apparatus comprising:

a braking element adapted for connection to a rear portion of the supporting frame adjacent the wheels;

a brake arm connected to the braking element and adapted for connection between the quarter of the skate and the braking element, the brake arm having a first member and a second member connected together, the first member being movable with respect to the second member, the brake arm including a switch mechanism operable between a first and second position, wherein upon activation of the switch mechanism from the first position to the second position, the first member of the brake arm moves away from the second member of the brake arm such that the length of the brake arm is increased and the braking element is adapted for positioning lower with respect to the wheels of the skate, and wherein upon activation of the switch mechanism from the second position to the first position, the first member moves toward the second member of the brake arm to decrease the length of the brake arm such that the braking element is adapted for positioning higher with respect to the wheels of the skate;

wherein the switch mechanism includes having the first and second members of the brake arm disposed with an end of the first member adjacent an end of the second member with the first member rotatably disposed therein, the adjacent ends of the first and second members formed as angled faces with the faces substantially parallel and in contact when the first member is in a first position, and wherein upon rotation of the first member to a second position, the angled face of the first member acts as a cam to force the first member away from the second member to increase the length of the brake arm.

2. The apparatus of claim 1 wherein the angled face of the second member includes a notched portion cut out of the angled face wherein upon rotation of the first member from the first to the second position, the angled cam face of the first member engages the notched portion of the second member to maintain the first member in the second position.

3. The apparatus of claim 2 further comprising a connecting rod and spring, the connecting rod disposed within the first and second members, the second member having a cavity such that one end of the connecting rod and the spring are disposed in the cavity with the spring biasing the angled cam face of the first member against the angled face of the second member.

4. A braking apparatus for use in a skate having a shoe composed of at least one quarter connected to a shell associated with a supporting frame for a plurality of wheels, the braking apparatus comprising:

a braking element adapted for connection to a rear portion of the supporting frame;

a brake arm connected to the braking element and adapted for connection between the quarter of the skate and the braking element, the brake arm having a first member and a second member connected together, the first member being moveable with respect to the second member, wherein the first and second members of the brake arm are disposed with an end of the first member adjacent an end of the second member with the first member rotatably disposed therein, the adjacent ends of the first and second members formed as angled faces with the faces substantially parallel and in contact when the first member is in a first position, and wherein upon rotation of the first member to a second position, the angled face of the first member acts as a cam to force the first member away from the second member to increase the length of the brake arm.

5. The apparatus of claim 4 wherein the angled face of the second member includes a notched portion cut out of the angled face wherein upon rotation of the first member from the first to the second position, the angled cam face of the first member engages the notched portion of the second member to maintain the first member in the second position.

6. The apparatus of claim 4 further comprising a connecting rod and spring, the connecting rod disposed within the first and second members, the second member having a cavity such that one end of the connecting rod and the spring are disposed in the cavity such that the spring biases the angled cam face of the first member against the angled face of the second member.

* * * * *